US007629745B2

(12) United States Patent
Kim

(10) Patent No.: US 7,629,745 B2
(45) Date of Patent: Dec. 8, 2009

(54) PLASMA DISPLAY APPARATUS

(75) Inventor: Yun Gi Kim, Busan-si (KR)

(73) Assignee: LG Electronics Inc., Seoul (KR)

( * ) Notice: Subject to any disclaimer, the term of this patent is extended or adjusted under 35 U.S.C. 154(b) by 323 days.

(21) Appl. No.: 11/554,061

(22) Filed: Oct. 30, 2006

(65) Prior Publication Data

US 2007/0138959 A1 Jun. 21, 2007

(30) Foreign Application Priority Data

Dec. 16, 2005 (KR) ..... 10-2005-0124727

(51) Int. Cl.
*H01J 17/49* (2006.01)

(52) U.S. Cl. ..... 313/582; 313/292

(58) Field of Classification Search ..... 313/582, 313/586, 252, 292
See application file for complete search history.

(56) References Cited

U.S. PATENT DOCUMENTS 5,905,336 A * 5/1999 Van Hal et al. ..... 313/497
5,925,262 A 7/1999 Choi
5,990,616 A * 11/1999 Lee et al. ..... 313/582
2004/0051457 A1 3/2004 Kimura
2005/0001551 A1 1/2005 Kim

OTHER PUBLICATIONS

European Search Report dated Jul. 18, 2008, for Application No. 06290940.3 (7 pages).

* cited by examiner

*Primary Examiner*—Vip Patel
(74) *Attorney, Agent, or Firm*—Fish & Richardson P.C.

(57) ABSTRACT

A plasma display apparatus is provided. The plasma display apparatus includes an upper substrate, a lower substrate that faces the upper substrate, and barrier ribs formed on the lower substrate to partition off discharge cells. At least one groove having a width no less than 0.1 times and no more than 0.8 times the width of the barrier rib is formed on the barrier rib. Therefore, it is possible to reduce a capacitance value between address electrodes and reduce reactive power formed between the electrodes so that it is possible to improve the discharge efficiency of the panel.

22 Claims, 6 Drawing Sheets

PLASMA DISPLAY APPARATUS

BACKGROUND OF THE INVENTION

1. Field of the Invention

The present invention relates to a plasma display apparatus, and more particularly, to a plasma display apparatus in which grooves or channels are formed on barrier ribs formed on a lower substrate of a panel to reduce capacitance between address electrodes formed on the lower substrate.

2. Description of the Background Art

A plasma display apparatus is a display in which vacuum ultraviolet (VUV) generated by discharging gases in a panel collides with phosphors in the panel to generate light. Voltages are properly applied to scan electrodes and sustain electrodes provided on an upper substrate of the plasma display apparatus and to address electrodes provided on a lower substrate of the plasma display apparatus to generate discharge and to display an image on a screen.

That is, voltages of the opposite polarities are applied to the scan electrodes and the address electrodes to select cells to generate discharge and voltages of the same magnitude are alternately applied to the scan electrodes, the sustain electrodes, and the address electrodes to generate discharge.

Here, the upper substrate and the lower substrate of the plasma display apparatus having the above structure are attached to each other by a sealing material so that black matrices of the upper substrate are attached to barrier ribs of the lower substrate and that discharge is generated between the barrier ribs.

Therefore, when the VUV is generated by discharge, the VUV excites the phosphors applied to the inside of the discharge space to emit light so that visible rays are generated to display an image on a screen.

The thickness of the phosphors is 10 μm to 20 μm. Since the dielectric constants of R, G, and B phosphor layers are different from each other, the discharge voltages by which the phosphor layers can generate the visible rays through discharge are different from each other.

However, according to the conventional plasma display apparatus having the above structure, capacitance is generated between the address electrodes by the barrier ribs formed on the lower substrate of the panel so that reactive power increases due to the capacitance between the electrodes during the driving of the panel.

In particular, higher driving voltage is required when single scan driving is performed in the panel than when dual scan driving is performed in the panel. Therefore, the capacitance between the address electrodes formed on the lower substrate increases so that the reactive power of the panel increases.

SUMMARY OF THE INVENTION

Accordingly, an object of the present invention is to solve at least the problems and disadvantages of the background art.

It is an object of the present invention to provide a plasma display apparatus in which grooves are formed on and between barrier ribs formed on a lower substrate of the plasma display apparatus so that capacitance is reduced between address electrodes formed on the lower substrate and that reactive power generated by the capacitance is reduced to reduce the reactive power of a panel.

According to a first aspect of the present invention, there is provided a plasma display apparatus comprising an upper substrate, a lower substrate that faces the upper substrate, and barrier ribs formed on the lower substrate to partition off discharge cells. At least one groove having a width no less than 0.1 times and no more than 0.8 times the width of the barrier rib is formed on the barrier rib.

According to a second aspect of the present invention, there is provided a plasma display apparatus comprising an upper substrate, a lower substrate that faces the upper substrate, and barrier ribs formed on the lower substrate to partition off discharge cells. At least one groove having a width no less than 0.5 times the height of the barrier rib is formed on the barrier rib.

According to a third aspect of the present invention, there is provided a plasma display apparatus comprising an upper substrate, a lower substrate that faces the upper substrate, and main barrier ribs formed on the lower substrate to partition off discharge cells. The main barrier rib comprises a first sub-barrier rib and a second sub-barrier rib separated from each other by a predetermined distance. The predetermined distance is no less than 0.1 times and no more than 0.8 times the width from one end of the first sub-barrier rib to the other end of the second sub-barrier rib.

BRIEF DESCRIPTION OF THE DRAWINGS

The accompanying drawings, which are comprised to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Preferred embodiments of the present invention will be described in a more detailed manner with reference to the drawings.

Figure 1:
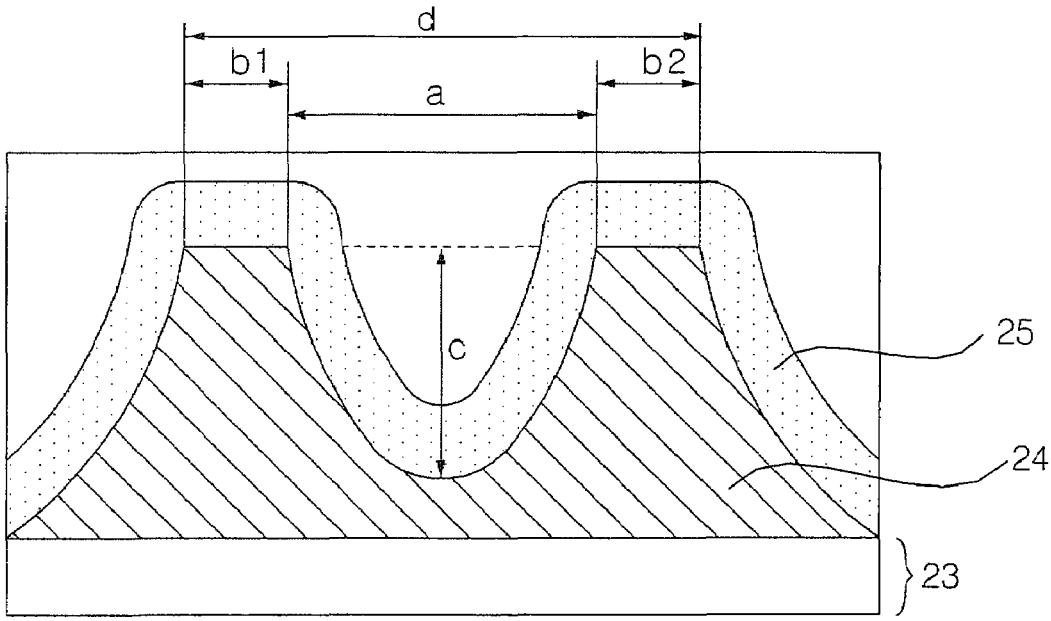
FIG. 1 is a sectional view illustrating a barrier rib of a plasma display apparatus according to a first embodiment of the present invention.

FIG. 1 is a sectional view illustrating a barrier rib of a plasma display apparatus according to a first embodiment of the present invention.

As illustrated in FIG. 1, the plasma display apparatus according to the first embodiment includes address electrodes (not shown) formed on a lower substrate 21, a white back 23 that is a white dielectric material formed on the address electrodes (not shown) to prevent discharge light from being transmitted to the lower substrate, barrier ribs 24 formed on the white back 23 to partition off discharge cells, and red (hereinafter, R), green (hereinafter, G), and blue (hereinafter, B) phosphor layers 25 applied to the side surfaces of the barrier ribs 24 and the bottom surfaces of discharge spaces to emit visible rays during discharge.

A groove having a width of a is formed on the barrier rib 24. Capacitance (hereinafter, Cp) formed between the address electrodes (not shown) is reduced by the groove.

Here, the groove a is preferably formed to the bottom. However, the groove has a width no less than 0.1 times and no more than 0.8 times, preferably, no less than 0.3 times and no more than 0.6 times the width d of the barrier rib in order to sustain the minimum stiffness of the barrier rib 24 and to secure the discharge cell space. The above-described width of the barrier rib is not the width of the bottom that contacts the white back of the lower substrate but the width of the top of the barrier rib.

That is, the width d of the barrier rib is obtained by adding the width b1 of the left top of the barrier rib and the width b2 of the right top of the barrier rib that are separated from each other by the groove and the width a of the groove to each other.

The above-describe groove is formed to reduce the capacitance Cp generated between the address electrodes and to increase cleaning efficiency when the phosphor layers 25 to be applied to the barrier rib 24 and the discharge space are dispensed.

The width b1 of the left top of the barrier rib and the width b2 of the right top of the barrier rib are equal to each other. That is, the groove is formed to be symmetrical with each other based on the groove.

In this case, at least one of the width b1 of the left top of the barrier rib and the width b2 of the right top of the barrier rib preferably has a value between 30 μm and 60 μm. When the width b1 of the left top of the barrier rib and the width b2 of the right top of the barrier rib are smaller than 30 cm, since the barrier rib becomes too thin so that the barrier rib becomes weak, it is difficult to sustain the form of the barrier rib or the barrier rib is easily damaged by shock.

The depth c of the groove is no less than 0.5 times the height of the barrier rib.

That is, since the height of the barrier rib is commonly 120 μm to 130 μm, the depth c of the groove is no less than 65 μm that is no less than 0.5 times the height of the barrier rib.

When the depth c of the groove is less than 0.5 times the height of the barrier rib, it is difficult to sufficiently reduce the capacitance.

In this case, the width of the top of the groove is 50 μm to 150 μm. In order to form the groove to the bottom, the width of the top of the groove is preferably 120 μm to 150 μm.

In this case, the phosphor layers 25 are formed on the top of the groove as well as on the barrier rib to cover the barrier rib and the groove.

Figure 2:
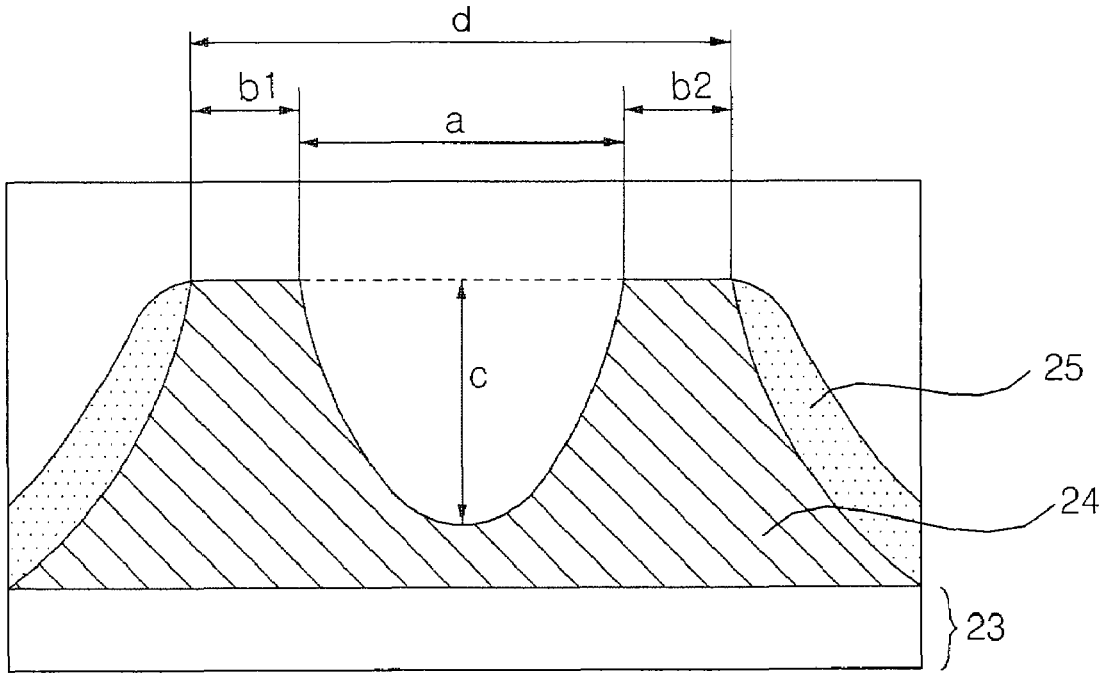
FIG. 2 is a sectional view illustrating a barrier rib of a plasma display apparatus according to a second embodiment of the present invention.

FIG. 2 is a sectional view illustrating a barrier rib of a plasma display apparatus according to a second embodiment of the present invention.

As illustrated in FIG. 2, the plasma display apparatus according to the second embodiment of the present invention is different from the plasma display apparatus according to the first embodiment of the present invention in that the phosphor layers 25 are not formed on the top of the barrier rib and on the groove.

Since the phosphor layers 25 are not formed on the top of the barrier rib, it is possible to improve contrast.

Figure 3:
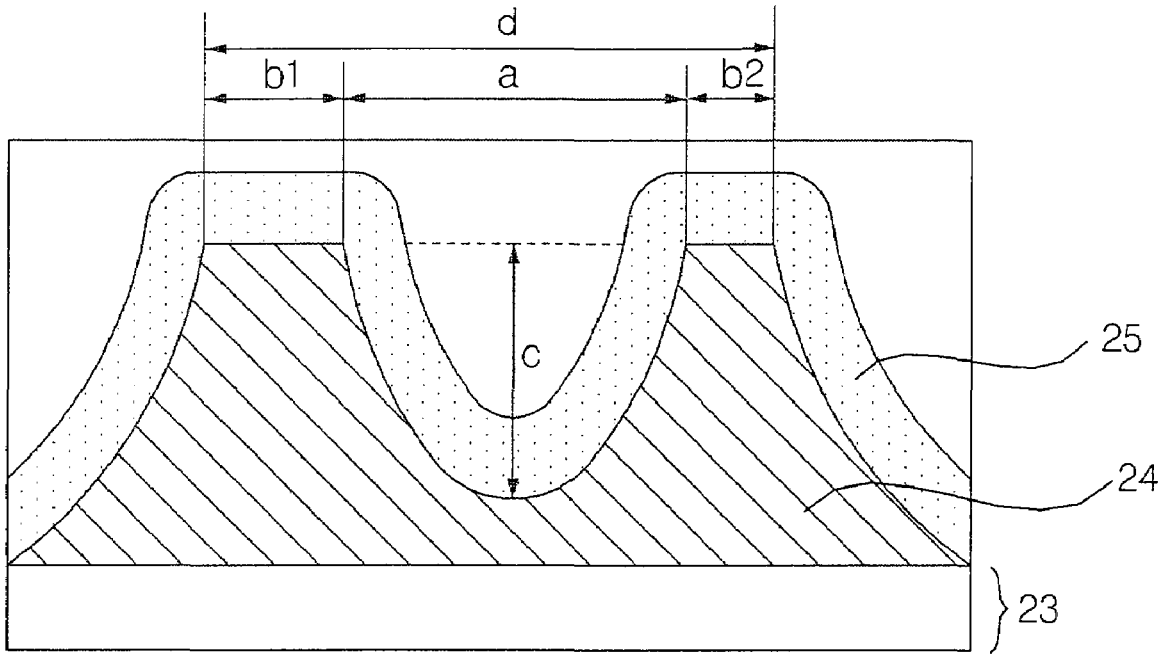
FIG. 3 is a sectional view illustrating a barrier rib of a plasma display apparatus according to a third embodiment of the present invention.

FIG. 3 is a sectional view illustrating a barrier rib of a plasma display apparatus according to a third embodiment of the present invention.

As described in FIG. 3, the plasma display apparatus according to the third embodiment of the present invention is different from the plasma display apparatus according to the first embodiment of the present invention in that the width b1 of the left top of the barrier rib and the width b2 of the right top of the barrier rib that are separated from each other are not equal to each other. Since the remaining structure of the plasma display apparatus according to the third embodiment of the present invention is the same as the structure of the plasma display apparatus according to the first embodiment of the present invention, description thereof will be omitted.

Figure 4:
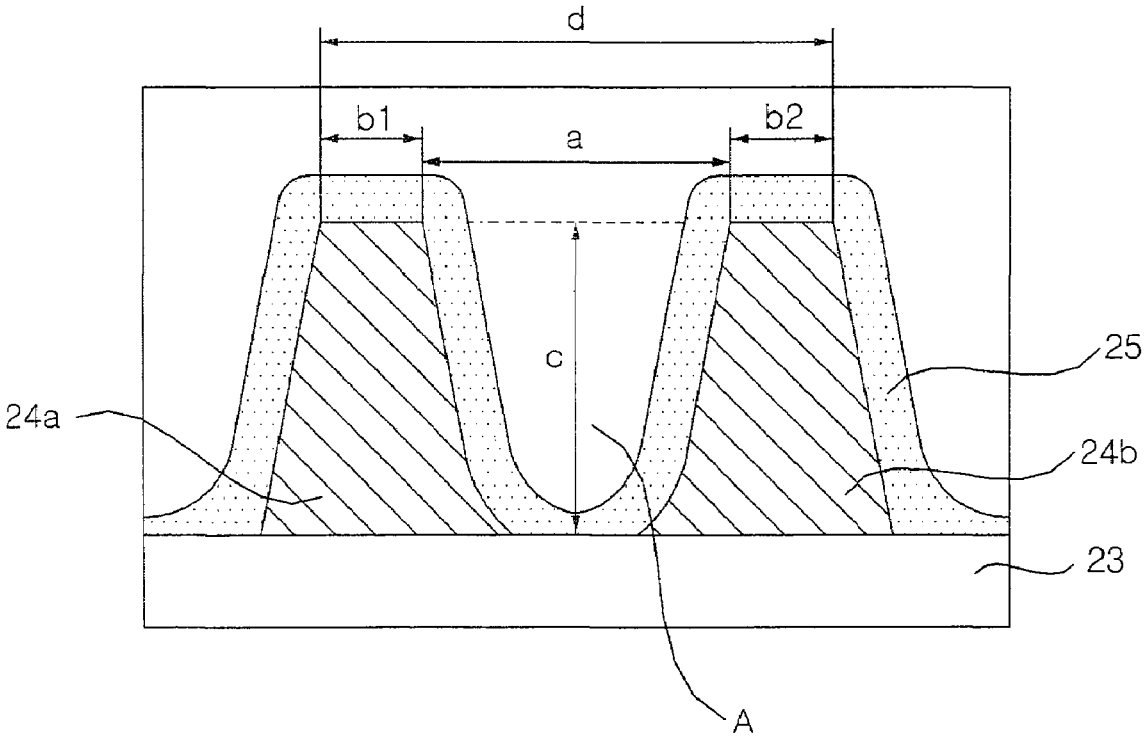
FIG. 4 is a sectional view illustrating a barrier rib of a plasma display apparatus according to a fourth embodiment of the present invention.

FIG. 4 is a sectional view illustrating a barrier rib of a plasma display apparatus according to a fourth embodiment of the present invention.

As illustrated in FIG. 4, a barrier rib is formed on a lower substrate of the plasma display apparatus according to the fourth embodiment of the present invention. The barrier rib includes a first sub-barrier rib 24*a* and a second sub-barrier rib 24*b* and a predetermined groove or channel A is formed between the first sub-barrier rib 24*a* and the second sub-barrier rib 24*b*. That is, the first sub-barrier rib 24*a* and the second sub-barrier rib 24*b* are separated from each other by a predetermined distance a.

A method of forming the channel between the first sub-barrier and the second sub-barrier will be described. A groove is formed on one barrier rib by the height c of the barrier rib so that the barrier rib having the width of d is divided into the first sub-barrier rib and the second sub-barrier rib to form the channel between the two sub-barrier ribs.

In another method, the first and second sub-barrier ribs are separated from each other by a predetermined distance to form the channel A.

Here, the width a of the groove A formed between the first sub-barrier rib 24*a* and the second sub-barrier rib 24*b* is no less than 0.1 times and no more than 0.8 times the width d from one end of the first sub-barrier rib 24*a* to the other end of the second sub-barrier rib 24*b*. The width a of the groove A is preferably no less than 0.3 times and no more than 0.6 times the width d from one end of the first sub-barrier rib 24*a* to the other end of the second sub-barrier rib 24*b*.

The width a of the predetermined distance or groove may be larger than the width b1 or b2 of the top of the sub-barrier rib.

The width b1 of the first sub-barrier rib or the width b2 of the second sub-barrier rib is no less than 0.1 times and no more than 0.45 times the width d from one end of the first sub-barrier rib to the other end of the second sub-barrier rib.

The depth c of the groove A is equal to the height of the first and second sub-barrier ribs 24*a* and 24*b*. That is, the groove is preferably formed to the bottom.

Figure 5:
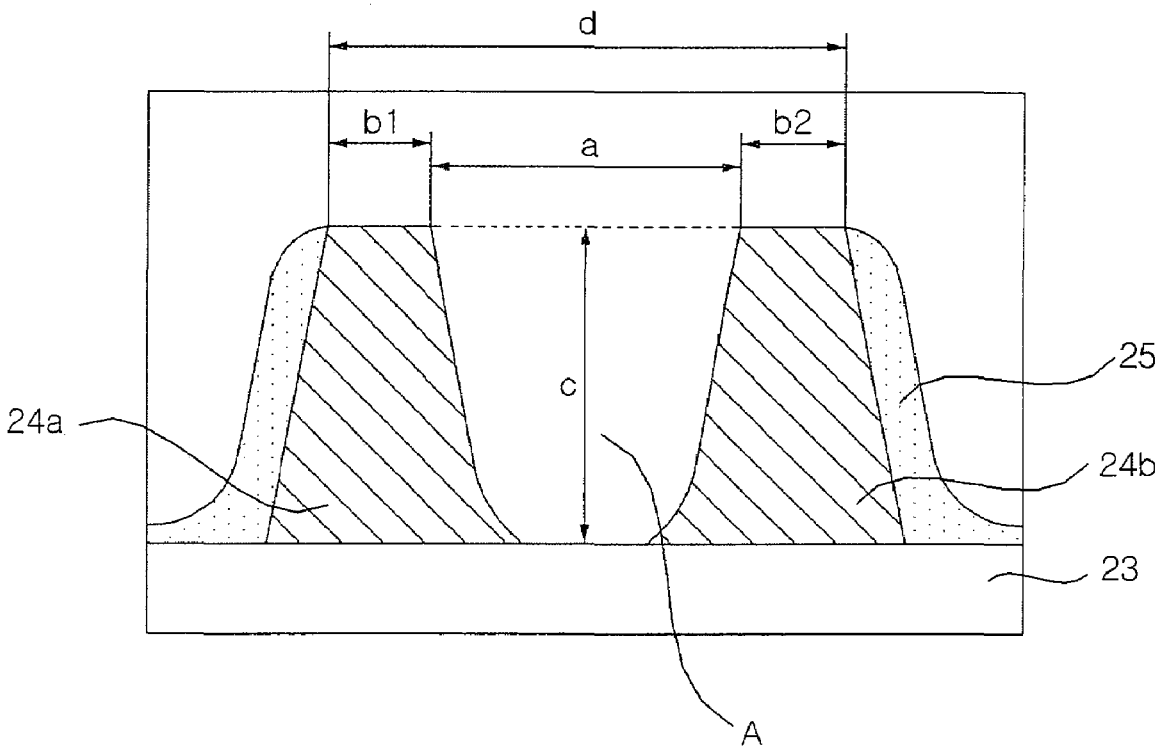
FIG. 5 is a sectional view illustrating a barrier rib of a plasma display apparatus according to a fifth embodiment of the present invention.

FIG. 5 is a sectional view illustrating a barrier rib of a plasma display apparatus according to a fifth embodiment of the present invention.

As illustrated in FIG. 5, the plasma display apparatus according to the fifth embodiment of the present invention is different from the plasma display apparatus according to the fourth embodiment in that the phosphor layers 25 are not formed on the top of the barrier rib and on the groove.

Since the phosphor layers 25 are not formed on the top of the barrier rib and on the groove, it is possible to improve contrast.

Figure 6:
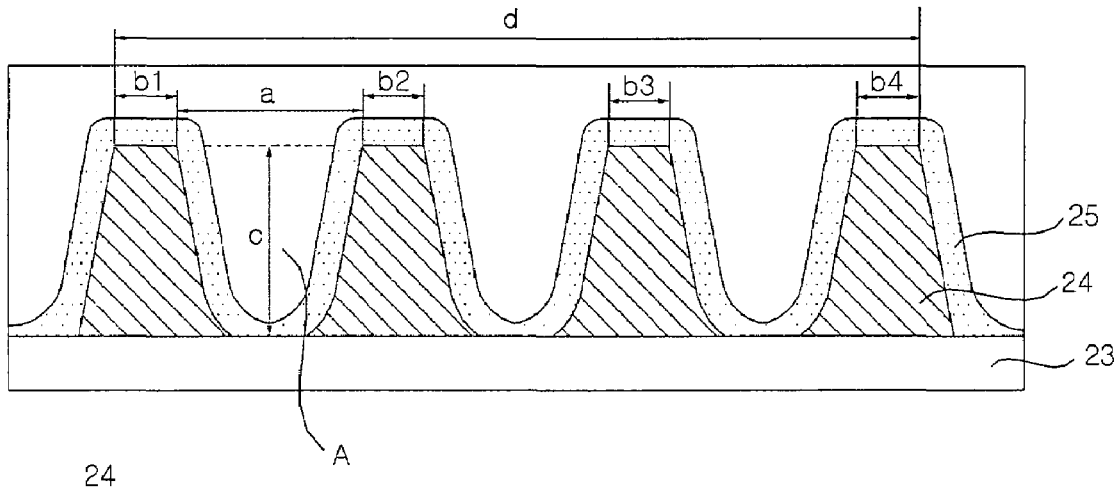
FIG. 6 is a sectional view illustrating a barrier rib of a plasma display apparatus according to a sixth embodiment of the present invention.

FIG. 6 is a sectional view illustrating a barrier rib of a plasma display apparatus according to a sixth embodiment of the present invention.

As illustrated in FIG. 6, in the plasma display apparatus according to the sixth embodiment of the present invention, a plurality of grooves are formed on the barrier rib. The structure of the plasma display apparatus according to the sixth embodiment of the present invention is basically the same as the structures of the plasma display apparatuses according to the above-described embodiments.

The widths b1 to b4 of the tops of the plurality of sub-barrier ribs separated from each other by the plurality of grooves may be equal to each other or may be different from each other.

At this time, the depth c of the groove may be no less than 0.5 times the height of the barrier rib and may be equal to the height of the barrier rib.

The first to sixth embodiments of the present invention as described above can be applied to vertical barrier ribs as well as to horizontal barrier ribs.

Figure 7:
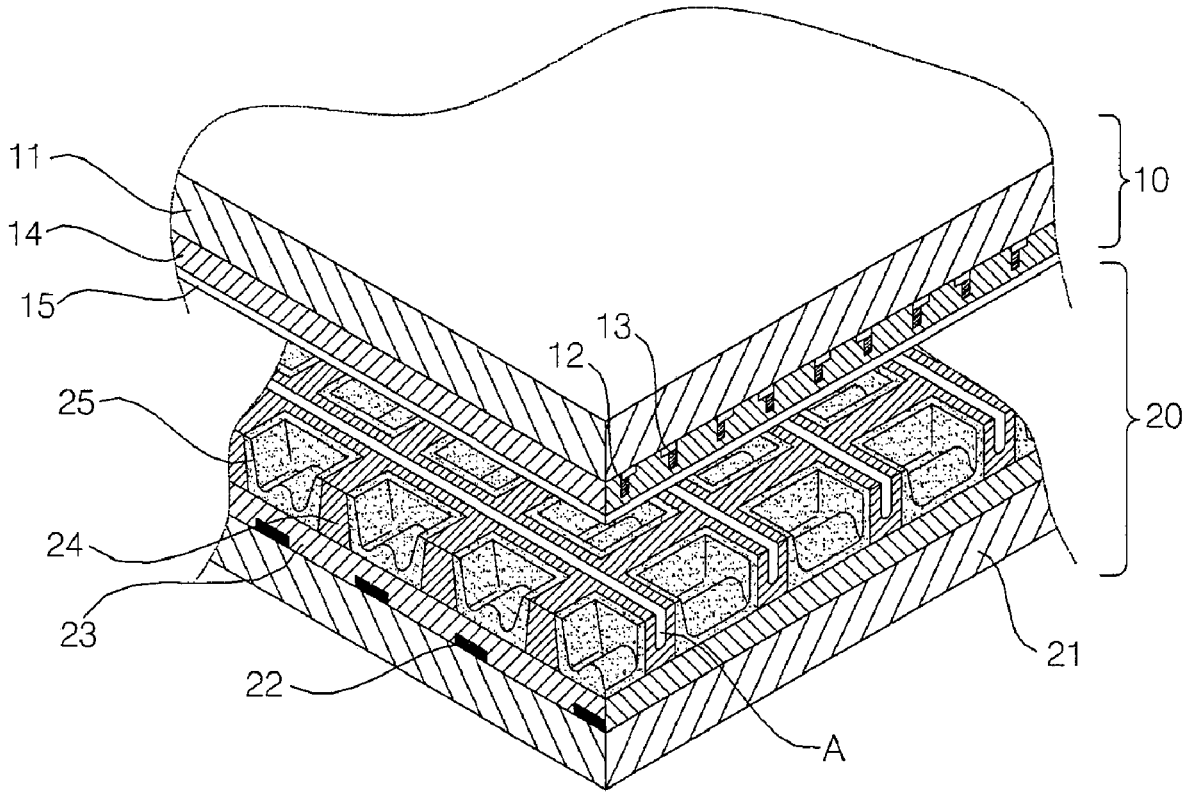
FIGS. 7 and 8 are perspective views illustrating that grooves are formed on horizontal barrier ribs of the plasma display apparatus according to the present invention.
Figure 8:
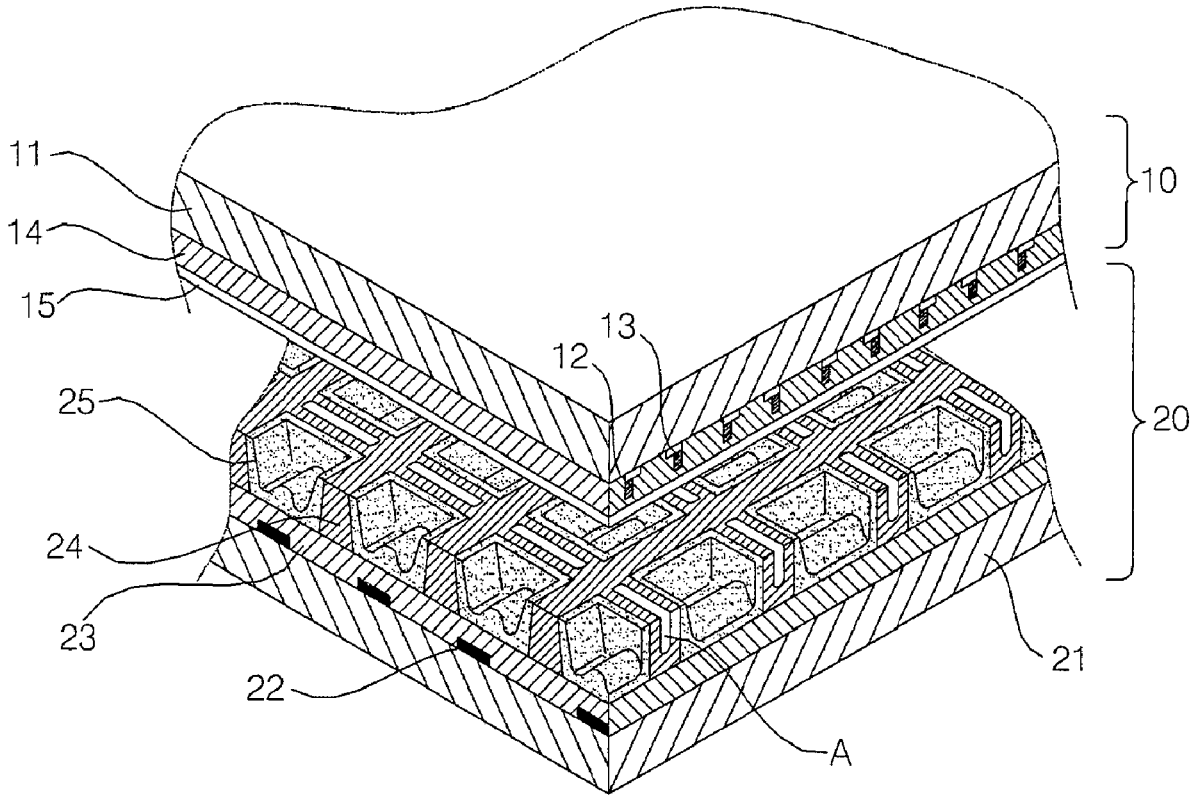
Figure 9:
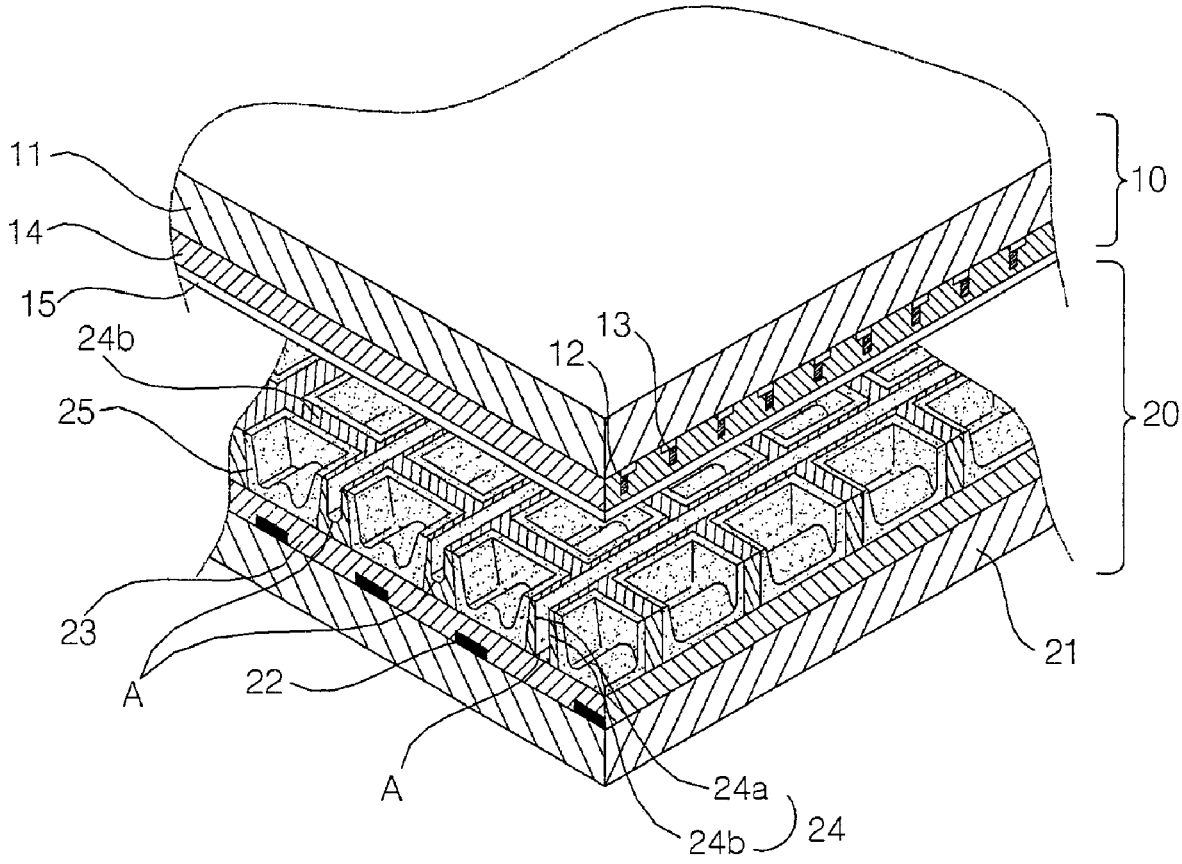
FIG. 9 is a perspective view illustrating that grooves are formed on vertical barrier ribs of the plasma display apparatus according to the present invention.

FIGS. 7 and 8 are perspective views illustrating that grooves are formed on the horizontal barrier ribs of the plasma display apparatus according to the present invention. FIG. 9 is a perspective view illustrating that grooves are formed on the vertical barrier ribs of the plasma display apparatus according to the present invention.

The structure of the plasma display apparatus according to the present invention will be described in detail with reference to FIGS. 7 to 9. As illustrated in FIGS. 7 to 9, the plasma display apparatus according to the present invention includes an upper panel 10 on which an image is displayed and a lower panel 20 that is separated from the upper panel 10 to run parallel to the upper panel 10.

Here, the upper panel 10 includes an upper substrate 11, a plurality of scan electrodes 12 and sustain electrodes 13 formed on the upper substrate 11 by a uniform distance, a dielectric layer 14 formed on the plurality of electrodes 12 and 13, and a dielectric protecting layer 15 formed on the dielectric layer 14.

The lower panel 20 includes a plurality of address electrodes 22 formed to intersect the scan electrodes 12 or the sustain electrodes 13 on the upper panel 10, a white back 23 formed on the address electrodes 22 to prevent discharge light from being transmitted, barrier ribs 24 that partition off a plurality of discharge spaces on the white back 23, and R, G, and B phosphor layers 25 applied to the side surfaces of the barrier ribs and the bottoms of the discharge spaces to emit visible rays during discharge.

Here, the upper and lower panels 10 and 20 are attached to each other with an inert gas filled therein and the attached panel is driven with time division into a reset period for initializing all of the cells in order to display an image, an address period for selecting a cell, and a sustain period for generating display discharge in the selected cell. High voltage is required for the discharge generated by the driving.

At this time, the panel is one large capacitor-type load so that the capacitance Cp value is charged in the panel, that is, between the dielectric layers 14 and 23 of the panel.

According as the capacitance value Cp charged in the panel increases, reactive current increases between the electrodes so that reactive power on the panel also increases.

Therefore, in the plasma display apparatus according to the present invention, in order to reduce the capacitance Cp value between the address electrodes 22 formed on the lower substrate 20 and to thus reduce the reactive power, predetermined grooves are formed on the barrier ribs 24 of the lower substrate 20.

Here, the grooves according to the first to third embodiments of the present invention may be formed on the barrier ribs in the effective display region of the plasma display apparatus and the grooves according to the fourth to sixth embodiments of the present invention may be formed on the barrier ribs in the non-display region outside the effective display region. This is because the width of the barrier rib in the non-display region may be larger than the width of the barrier rib in the effective display region so that the stiffness of the barrier ribs does not deteriorate although the depth of the grooves increases or the plurality of grooves are formed.

First, the barrier ribs formed on the effective display region will be described. The width a of the grooves formed on the barrier ribs 24 is no less than 0.1 times and no more than 0.8 times the width of the barrier ribs 24 and is preferably no less than 0.3 times and no more than 0.6 times.

The widths (b1 and b2 of FIG. 1) of the left and right tops of the barrier rib 24 on which the groove A is formed are equal to each other, that is, no less than 0.1 times and no more than 0.45 times the width of the barrier rib 24 and the depth of the groove A is no less than 0.5 times the height of the barrier rib 24.

At this time, the groove A preferably has the depth no less than 0.7 times the height of the barrier rib.

When the width a of the groove A is less than 0.1 times the height of the barrier rib, it is not possible to sufficiently reduce the reactive power of the panel. When the width a of the groove A is larger than 0.8 times the height of the barrier rib, it is difficult to sustain the stiffness of the barrier rib 24 of the panel so that the barrier rib collapses.

When the depth c of the groove A is less than 0.5 times the height of the barrier rib 24, it is not possible to sufficiently reduce the reactive current between the address electrodes of the lower substrate 20.

In the plasma display apparatus according to the present invention, the barrier rib in the non-display region may include a first sub-barrier rib 24*a* and a second sub-barrier rib 24*b* so that a groove by a may be formed between the first and second sub-barrier ribs 24*a* and 24*b*. In order to divide the barrier rib into two sub-barrier ribs, the depth of the groove is preferably equal to the height of the barrier rib.

Here, the width a of the groove is no less than 0.1 times and no more than 0.8 times, preferably, no less than 0.3 times and no more than 0.6 times the width d from one end of the first sub-barrier rib 24*a* to the other end of the second sub-barrier rib 24*b*. The widths b1 and b2 of the first and second sub-barrier ribs 24*a* and 24*b* between which the groove A is formed are preferably equal to each other.

The width a of the groove is preferably no less than 0.1 times and no more than 0.45 times the width D from one end of the first sub-barrier rib 24*a* to one end of the second sub-barrier rib 24*b* and the depth of the groove A is preferably equal to the height of the barrier rib.

At this time, when the width a of the groove is less than 0.1 times the width D from one end of the first sub-barrier rib 24*a* to one end of the second sub-barrier rib 24*b*, it is not possible to sufficiently reduce the reactive power. When the width a of the groove is larger than 0.8 times the width D from one end of the first sub-barrier rib 24*a* to one end of the second sub-barrier rib 24*b*, it is difficult to sustain the stiffness of the first and second sub-barrier ribs 24*a* and 24*b* of the panel.

When the depth c of the groove A is less than 0.5 times the height of the first and second sub-barrier ribs, it is not possible to sufficiently reduce the capacitance between the address electrodes formed on the lower panel 20.

Since the groove A is formed, it is possible to obtain high cleaning effect when the phosphor layers 25 to be applied to the lower panel 20 are dispensed.

Therefore, according to the plasma display apparatus having the above structure, the groove A having a predetermined width is formed on the barrier rib 24 on the lower panel 20 of the panel to reduce the reactive power formed on the panel due to the capacitance Cp value between the address electrodes 22 on the lower panel 20 and the reactive current that flows between the address electrodes 22.

In particular, as illustrated in FIG. 8, the grooves can be formed in uniform parts on the barrier ribs. That is, when the groove is formed on the horizontal barrier rib, the groove can be formed only on the barrier rib positioned on the boundary between one discharge cell and a discharge cell adjacent to the discharge cell. At this time, the grooves are not formed on the points where the horizontal barrier ribs and the vertical barrier ribs intersect each other so that it is possible to secure the stiffness of the entire barrier ribs.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

In the plasma display apparatus according to the present invention having the above structure, since the groove is formed on the barrier rib or between the sub-barrier ribs on the lower substrate of the panel to reduce the capacitance value between the address electrodes on the lower substrate and to thus reduce the reactive power formed between electrodes, it is possible to improve the discharge efficiency of the panel.

What is claimed is:

1. A plasma display apparatus comprising:

an upper substrate;

a lower substrate that faces the upper substrate; and barrier ribs comprising horizontal barrier ribs and vertical barrier ribs, and formed on the lower substrate to partition off discharge cells, wherein at least one groove having a width no less than 0.1 times and no more than 0.8 times a width of a vertical barrier rib is formed on the vertical barrier rib.

2. The plasma display apparatus as claimed in claim 1, wherein the width of the vertical barrier rib is the width of the top of the vertical barrier rib.

3. The plasma display apparatus as claimed in claim 1, wherein the width of the at least one groove is no less than 0.3 times and no more than 0.6 times the width of the vertical barrier rib.

4. The plasma display apparatus as claimed in claim 1, wherein the width of the at least one groove is 50 μm to 150 μm.

5. The plasma display apparatus as claimed in claim 1, wherein the top of the vertical barrier rib on the left side of the at least one groove and the top of the vertical barrier rib on the right side of the at least one groove are equal to each other.

6. The plasma display apparatus as claimed in claim 1, wherein one of the left and right tops of the vertical barrier rib is 30 μm to 60 μm.

7. The plasma display apparatus as claimed in claim 1, wherein the width of the at least one groove is larger than one of the left and right tops of the vertical barrier rib.

8. The plasma display apparatus as claimed in claim 1, wherein the depth of the at least one groove is no less than 0.5 times the height of the vertical barrier rib.

9. The plasma display apparatus as claimed in claim 8, wherein the depth of the at least one groove is no less than 0.7 times the height of the vertical barrier rib.

10. The plasma display apparatus as claimed in claim 1, wherein phosphors are formed on the at least one groove.

11. The plasma display apparatus as claimed in claim 1, wherein the verticcal barrier rib on which the at least one groove is formed is continuous and intersects a plurality of the horizontal barrier ribs.

12. The plasma display apparatus as claimed in claim 1, wherein the vertical barrier rib on which the at least one groove is formed is unbroken along a segment that intersects at least several horizontal barrier ribs.

13. The plasma display apparatus as claimed in claim 1, wherein the width of the at least one groove continuously varies with respect to the depth of the at least one groove and the width at a top opening of the at least one groove is no less than 0.1 times and no more than 0.8 times the width of at least one of the vertical barrier ribs.

14. The plasma display apparatus as claimed in claim 1, wherein the vertical barrier ribs comprise barrier ribs formed parallel to a plurality of address electrodes.

15. A plasma display apparatus comprising:

an upper substrate;

a lower substrate that faces the upper substrate; and barrier ribs comprising horizontal barrier ribs and vertical barrier ribs, and formed on the lower substrate to partition off discharge cells, wherein at least one groove having a depth no less than 0.5 times the height of a vertical barrier rib is formed on the vertical barrier rib.

16. The plasma display apparatus as claimed in claim 15, wherein the depth of the at least one groove is no less than 0.7 times the height of the vertical barrier rib.

17. The plasma display apparatus as claimed in claim 15, wherein the depth of the at least one groove is equal to the height of the vertical barrier rib.

18. The plasma display apparatus as claimed in claim 15, wherein phosphors are formed on the at least one groove.

19. A plasma display apparatus comprising:

an upper substrate;

a lower substrate that faces the upper substrate; and vertical barrier ribs formed on the lower substrate to partition off discharge cells, wherein at least one of the vertical barrier ribs comprises a first sub-barrier rib and a second sub-barrier rib separated from each other by a predetermined distance, and wherein the predetermined distance is no less than 0.1 times and no more than 0.8 times the width from one end of the first sub-barrier rib to the other end of the second sub-barrier rib.

20. The plasma display apparatus as claimed in claim 19, wherein the width of the top of the first sub-barrier rib and the width of the top of the second sub-barrier are equal to each other.

21. The plasma display apparatus as claimed in claim 19, wherein the predetermined distance is larger than the width of the top of the first sub-barrier rib or second sub-barrier rib.

22. The plasma display apparatus as claimed in claim 19, wherein the predetermined distance is no less than 0.3 times and no more than 0.6 times the width from one end of the first sub-barrier rib to the other end of the second sub-barrier rib.

* * * * *